US010966472B2

(12) United States Patent
Melofchik

(10) Patent No.: US 10,966,472 B2
(45) Date of Patent: Apr. 6, 2021

(54) CHEST PROTECTORS FOR REDUCING RISK OF COMMOTIO CORDIS

(71) Applicant: EASTON DIAMOND SPORTS, LLC, Thousand Oaks, CA (US)

(72) Inventor: Ryan Melofchik, Los Angeles, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 95 days.

(21) Appl. No.: 16/235,644

(22) Filed: Dec. 28, 2018

(65) Prior Publication Data

US 2020/0205491 A1 Jul. 2, 2020

(51) Int. Cl.
*A41D 13/015* (2006.01)
*A41D 13/05* (2006.01)
(Continued)

(52) U.S. Cl.
CPC ..... *A41D 13/0518* (2013.01); *A41D 13/015* (2013.01); *A41D 13/0568* (2013.01); *A63B 71/12* (2013.01); *A41D 2500/50* (2013.01); *A41D 2600/10* (2013.01); *A63B 2071/1208* (2013.01)

(58) Field of Classification Search
CPC ..... A63B 71/12; A63B 2071/1208; A63B 2071/125; A63B 2071/1258; A63B 2071/1283; A63B 71/1225; A63B 2071/1241; A63B 2102/24; A63B 2225/09; A63B 71/08; A63B 2243/00; A41D 13/0518; A41D 13/0153; A41D 13/0568;
(Continued)

(56) References Cited

U.S. PATENT DOCUMENTS 1,670,239 A 5/1928 Clineet et al.
3,574,861 A * 4/1971 Hale ..... A63B 71/12 2/462
(Continued)

FOREIGN PATENT DOCUMENTS

EP 2515067 A1 10/2012
JP 2005194677 A 7/2005
WO 2017173095 A1 10/2017

OTHER PUBLICATIONS

U.S. Appl. No. 15/954,515, filed Apr. 16, 2018, Rusakov et al.
(Continued)

*Primary Examiner* — Robert H Muromoto, Jr.
(74) *Attorney, Agent, or Firm* — Perkins Coie LLP

(57) ABSTRACT

A chest protector includes a structure for protecting at least a portion of a cardiac silhouette of a user. The structure may include a base assembly, a pivot plate assembly, and a fulcrum block positioned between the pivot plate assembly and the base assembly. The pivot plate assembly is positioned to pivot on the fulcrum block. In some embodiments, the pivot plate assembly and the fulcrum block may include compressible and resilient material. The structure may be shaped, sized, and positioned to coextend with a region of the user's cardiac silhouette. In some embodiments, the pivot plate assembly includes two pivot plate portions oriented at an angle relative to one another. The pivot plate portions may be connected with a flexible hinge, such as a living hinge.

20 Claims, 3 Drawing Sheets

(51) Int. Cl.
*A63B 71/12* (2006.01)
*A41D 13/00* (2006.01)

(58) Field of Classification Search
CPC ..... A41D 13/0005; A41D 13/0543; A41D 2600/102; A43B 5/18; A45F 3/06
See application file for complete search history.

(56) References Cited

U.S. PATENT DOCUMENTS 4,183,097 A * 1/1980 Mellian ..... F41H 1/02 2/2.5
4,272,847 A * 6/1981 Buhler ..... A63B 71/12 2/461
4,516,273 A * 5/1985 Gregory ..... A63B 71/12 2/462
4,525,875 A * 7/1985 Tomczak ..... A41D 13/0518 2/2.5
4,590,621 A * 5/1986 Flosi ..... A63B 71/12 2/462
4,660,223 A * 4/1987 Fritch ..... B32B 15/14 2/2.5
4,694,505 A * 9/1987 Flosi ..... A41D 13/0153 2/462
4,847,913 A * 7/1989 Chen ..... A41D 13/0156 2/463
4,868,926 A * 9/1989 Lowson ..... A63B 71/1225 2/22
4,989,265 A * 2/1991 Nipper ..... A41D 13/0518 2/267
4,993,076 A * 2/1991 Dierickx ..... A41D 13/0158 2/2.5
5,020,156 A * 6/1991 Neuhalfen ..... A41D 13/0518 2/2.5
5,020,547 A * 6/1991 Strock ..... A41D 13/0506 128/891
5,093,931 A * 3/1992 LaBerge ..... A63B 71/12 2/22
5,173,964 A * 12/1992 Ball ..... A63B 71/12 2/267
5,325,537 A * 7/1994 Marion ..... A41D 13/0153 2/102
5,623,729 A * 4/1997 Chen ..... A41D 13/0153 2/2.5
5,742,947 A * 4/1998 Davis ..... A63B 71/12 2/463
5,933,874 A * 8/1999 Randolph ..... A41D 13/0518 2/267
6,161,226 A * 12/2000 Serewicz ..... A41D 13/015 2/45
6,182,299 B1 * 2/2001 Chen ..... A41D 13/0518 2/463
6,233,737 B1 * 5/2001 Ditchfield ..... F41H 1/02 2/2.5
6,302,490 B1 * 10/2001 Hanna ..... B60R 22/024 297/487
6,336,458 B1 * 1/2002 Nafziger ..... A41D 13/1245 128/846
6,519,782 B2 * 2/2003 Collins ..... A41D 13/0158 2/463
6,678,899 B2 * 1/2004 Fiorini ..... A41D 13/0156 2/463
6,738,984 B2 * 5/2004 Gillen ..... A41D 31/285 2/2.5
6,748,601 B2 * 6/2004 LaShoto ..... A41D 13/015 2/102
6,775,851 B1 * 8/2004 Chen ..... A41D 13/0156 2/463
6,789,274 B1 * 9/2004 Karpati ..... A41D 13/0053 2/458
6,826,786 B2 * 12/2004 Fiorini ..... A41D 13/0518 2/463
6,880,172 B2 * 4/2005 Quintero ..... A41D 13/08 2/16
7,065,800 B2 * 6/2006 Brown ..... A41D 13/0153 2/463
7,181,772 B2 * 2/2007 Gillen ..... A41D 13/0153 2/102
7,503,080 B2 * 3/2009 Link ..... A41D 13/0518 2/463
7,735,161 B2 * 6/2010 Purington ..... A41D 13/0518 2/463
7,765,615 B2 * 8/2010 Eastwood ..... A41D 13/0518 2/115
7,823,218 B2 * 11/2010 Goyer ..... A41D 13/0543 2/22
7,877,820 B2 * 2/2011 Landi ..... A41D 13/0518 2/463
7,900,283 B1 * 3/2011 Chen ..... F41H 1/00 2/267
7,941,867 B2 * 5/2011 Olson ..... A61F 5/0104 2/22
7,993,277 B1 * 8/2011 Link ..... A61B 5/0402 2/463
8,024,820 B2 * 9/2011 Weimer ..... A41D 13/0518 2/463
8,336,112 B2 12/2012 Weber et al.
8,353,067 B2 * 1/2013 Chen ..... A41D 13/0518 2/463
8,621,674 B2 * 1/2014 Perreault ..... A63B 69/0002 2/267
8,869,316 B2 * 10/2014 Lewis ..... F41H 1/02 2/463
8,959,671 B1 * 2/2015 Mandak ..... A41D 13/0518 2/455
9,174,111 B2 * 11/2015 Smith ..... A63B 71/08
9,440,136 B2 * 9/2016 Smith ..... A63B 71/1225
9,592,177 B2 3/2017 Nour
9,616,315 B2 * 4/2017 Smith ..... A63B 71/1225
10,001,246 B2 * 6/2018 Sitzmann ..... F16M 13/04
10,052,546 B2 * 8/2018 Kucera ..... A63B 71/12
10,145,507 B2 * 12/2018 Swan ..... F16M 13/04
2002/0162162 A1 * 11/2002 Collins ..... A41D 13/0158 2/463
2003/0024035 A1 * 2/2003 Fiorini ..... A41D 13/0518 2/463
2003/0046752 A1 * 3/2003 Baumann ..... A63B 71/12 2/463
2003/0079271 A1 * 5/2003 Gillen ..... A41D 13/08 2/102
2004/0143881 A1 * 7/2004 Fiorini ..... A41D 13/0518 2/69
2004/0199983 A1 * 10/2004 Gillen ..... A41D 31/14 2/456
2005/0241052 A1 * 11/2005 Brown ..... A41D 13/0518 2/463
2005/0251901 A1 * 11/2005 Link ..... A41D 13/0518 2/462
2006/0005306 A1 * 1/2006 Call ..... A41D 13/0518 2/463
2006/0048292 A1 * 3/2006 Gillen ..... A41D 13/0153 2/456
2006/0080762 A1 * 4/2006 Kobren ..... A41D 13/0158 2/463
2006/0107433 A1 * 5/2006 Olson ..... A63B 71/08 2/22
2006/0277669 A1 * 12/2006 Mott ..... A41D 13/0518 2/463
2007/0136935 A1 * 6/2007 Purington ..... A41D 13/0518 2/463
2008/0216219 A1 * 9/2008 Desnoyers ..... A41D 13/0153 2/463
2008/0235855 A1 * 10/2008 Kobren ..... A41D 13/0518 2/463
2009/0211001 A1 * 8/2009 Weimer ..... A63B 71/12 2/463
2010/0132099 A1 * 6/2010 Green ..... C08J 3/005 2/455

(56) References Cited

U.S. PATENT DOCUMENTS

2010/0205724 A1* 8/2010 Kamradt ..... A41D 13/0543 2/459
2011/0131713 A1* 6/2011 DaRosa ..... F41H 1/02 2/463
2011/0167546 A1* 7/2011 Olson ..... A61F 5/0104 2/455
2011/0167548 A1* 7/2011 Jourde ..... A41D 13/0512 2/463
2011/0185464 A1 8/2011 Weber et al.
2011/0219524 A1* 9/2011 Perreault ..... A41D 13/0518 2/463
2011/0307999 A1* 12/2011 Jourde ..... A63B 71/12 2/462
2012/0311774 A1* 12/2012 Chen ..... A41D 13/0518 2/463
2013/0000024 A1* 1/2013 Perreault ..... A41D 13/0518 2/463
2014/0007330 A1* 1/2014 Smith ..... A63B 71/12 2/463
2014/0150154 A1 6/2014 Aquino
2014/0359912 A1* 12/2014 Sutton ..... A41D 13/015 2/16
2015/0082507 A1 3/2015 Howland et al.
2015/0237924 A1* 8/2015 Cosio ..... A41D 13/0005 2/459
2016/0302496 A1* 10/2016 Ferrara ..... A41D 13/015
2016/0346663 A1* 12/2016 Kucera ..... A63B 71/12
2016/0377139 A1* 12/2016 Vito ..... A63B 71/0054 267/141
2017/0143054 A1* 5/2017 Yoon ..... A63B 71/1225
2017/0311659 A1* 11/2017 Guidetti ..... A41D 13/0518
2018/0049484 A1* 2/2018 Markison ..... A41D 13/065
2018/0099206 A1* 4/2018 Staub ..... A41D 19/01523
2018/0160747 A1* 6/2018 Epperson ..... A41D 13/0512
2019/0037936 A1* 2/2019 Schmidt ..... A41D 13/0518
2019/0183267 A1* 6/2019 Pham ..... A47G 9/1036
2019/0313712 A1* 10/2019 Rusakov ..... A41D 13/0156
2019/0357605 A1* 11/2019 Homan ..... A41D 13/0518
2020/0037680 A1* 2/2020 Person ..... A41D 13/0518

OTHER PUBLICATIONS

Dimock, Gabe, "Blocking Technique: Should Catchers Move Forward When They Block?", Baseball Rebellion, available at https://baseballrebellion.com/gabedimock/blocking-technique-should-catchers-move-forward-when-they-block/, posted Nov. 10, 2016; website visited Sep. 16, 2018.

Easton Lacrosse, "Easton Stealth Goalie Lacrosse Chest Protector," http://www.lacrossegearreview.com/easton, exact publication date unknown, available at least as early as Apr. 29, 2016.

Falco, K., "Mandalorian Mercs Costume Club", [online]. Jul. 28, 2015 [retrieved on Jul. 5, 2017], Retrieved from the Internet: <URL:http://mandalorianmercs.org/forum/index.php?topic=74545.0>.

Unequal, "Do You Know Commotio?" Brochure, received by Applicant at least as early as Jan. 2018, 2 pages.

Unequal, HART Catcher Chest Protector, Product Webpage, available at https://unequal.com/hart-catcher-chest-protector/, exact publication date unknown, website accessed on Mar. 8, 2019.

USPTO, Final Office Action in U.S. Appl. No. 15/143,330. dated Jul. 12, 2018.

USPTO, "International Search Report and Written Opinion", for PCT/US17/29473, dated Aug. 14, 2017, pgs.

USPTO, Non-Final Office Action dated Nov. 15, 2017 for Appl. No. 15/143,330, 29 pgs.

UT Southwestern Medical Center Newsroom, "Cardiologist seeks to end blow-to-chest deaths in teen athletes," available at utsouthwestern.edu/newsroom/articles/year-2017/commotion-cordis-link.html, Mar. 14, 2017.

Wilson Sporting Goods, "Promotion Fastpitch Chest Protector," http://www.wilson.com/enus/fastpitch/protective-gear/catcher/promotion-fastpitch-chest-protector, exact publication date unknown, available at least as early as Apr. 29, 2016.

* cited by examiner

CHEST PROTECTORS FOR REDUCING RISK OF COMMOTIO CORDIS

BACKGROUND

Athletes and others engaged in sports or other activities who receive a blow to the chest from a ball, a bat, or a collision with another object or another person may be at risk of death due to ventricular fibrillation, which is commonly known as commotio cordis. Commotio cordis can be triggered by an impact to the region of a user's chest known as the cardiac silhouette, which is the anterior region of the user's body near the heart that presents a risk of commotio cordis when it receives an impact. Accordingly, the cardiac silhouette should be protected.

SUMMARY

Representative embodiments of the present technology include a chest protector with a structure for protecting at least a portion of a cardiac silhouette of a user. The structure may include a base assembly, a pivot plate assembly, and a fulcrum block positioned between the pivot plate assembly and the base assembly. The pivot plate assembly is positioned to pivot on the fulcrum block. In some embodiments, the pivot plate assembly and the fulcrum block may include compressible and resilient material. The pivot plate assembly and the base assembly may be shaped, sized, and positioned to coextend with a region of the user's cardiac silhouette. In some embodiments, the pivot plate assembly includes two pivot plate portions oriented at an angle relative to one another. The pivot plate portions may be connected with a flexible hinge, such as a living hinge. The pivoting movement of pivot plate assemblies configured in accordance with embodiments of the present technology dynamically deflect impact energy away from the cardiac silhouette when a ball hits the chest protector, and the deformable or compressible nature of the components of the structures facilitates passive absorption or dissipation of impact energy.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views:

FIG. 2 illustrates a schematic cross-sectional view of the structure shown in

FIG. 1.

DETAILED DESCRIPTION

The present technology is directed to chest protectors for reducing the risk of commotio cordis. Various embodiments of the technology will now be described. The following description provides specific details for a thorough understanding and enabling description of these embodiments. One skilled in the art will understand, however, that the technology may be practiced without many of these details. Additionally, some well-known structures or functions, such as those common to chest protectors (including straps, connectors, or liners, for example), may not be shown or described in detail so as to avoid unnecessarily obscuring the relevant description of the various embodiments. Accordingly, embodiments of the present technology may include additional elements or exclude some of the elements described below with reference to FIGS. 1-4, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Specific details of several embodiments of the present technology are described herein with reference to catcher's chest protectors for baseball or softball. Embodiments of the present technology may be used in other sports or activities in which commotio cordis is a risk to be reduced or prevented.

Figure 1:
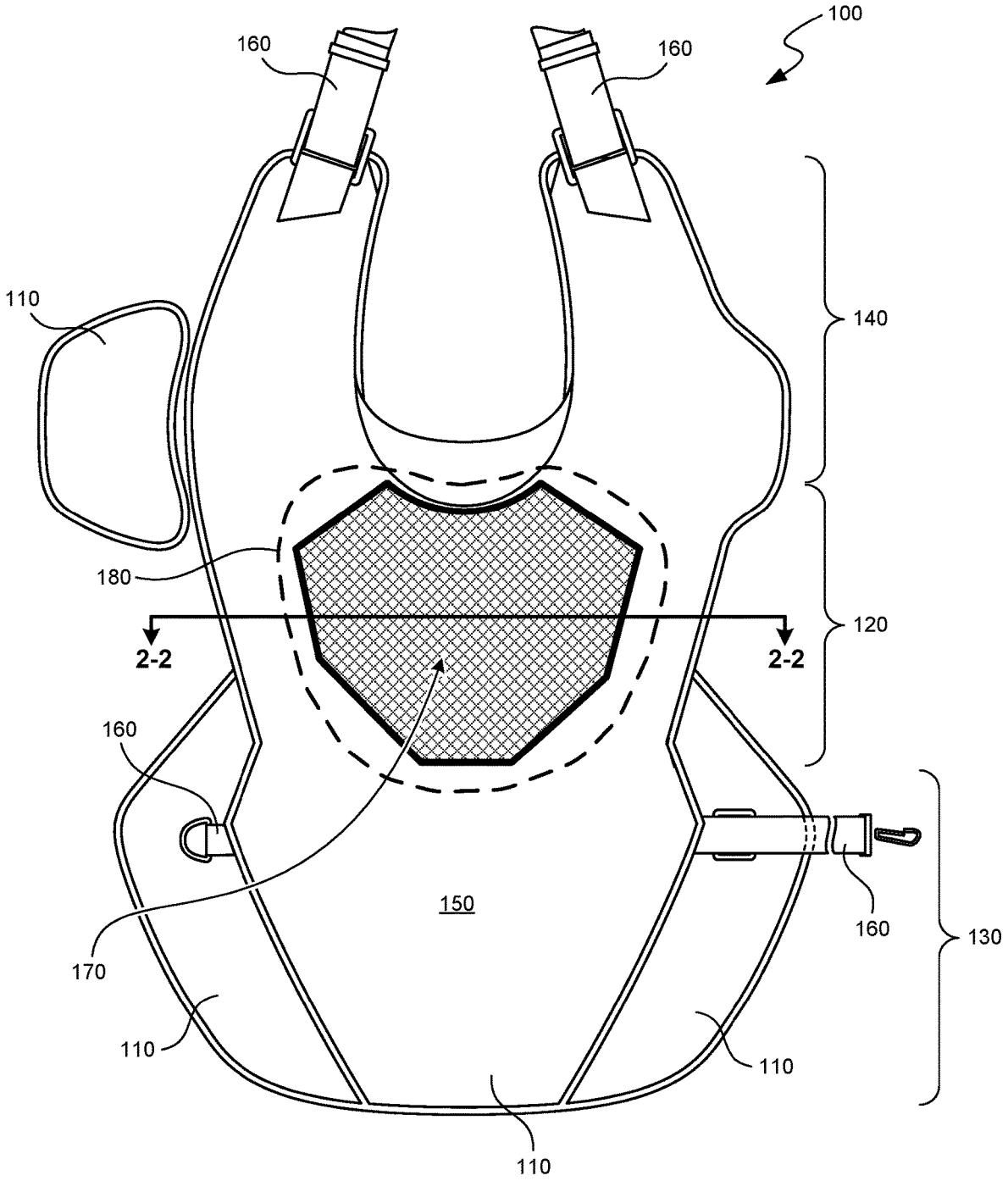
FIG. 1 illustrates a front view of a catcher's chest protector having a structure configured to reduce the risk of commotio cordis, in accordance with embodiments of the present technology.

Turning to the drawings, FIG. 1 illustrates a front view of a catcher's chest protector 100 configured to reduce the risk of commotio cordis in accordance with embodiments of the present technology. The chest protector 100 may include one or more panels 110 (which may be flexible) configured to generally conform to a user's anterior torso region, such as portions of a user's chest region or portions of a user's abdominal region. For example, a chest part 120 of the chest protector 100 may generally conform with a user's chest region, while an abdominal part 130 may generally conform with a user's abdominal region, and one or more shoulder parts 140 may generally conform with a user's shoulder region. A person of ordinary skill in the art will understand the regions of a body protected by a catcher's chest protector.

The panels 110 may include padding or padded sections to absorb energy when a ball impacts the chest protector 100. For example, the flexible panels 110 may include a cushion material positioned between an anterior surface 150 of the chest protector (facing away from the user when the user dons the chest protector 100) and a user-facing surface opposite the anterior surface 150. The flexible panels 110 may articulate relative to each other to conform to a user's body. The chest protector 100 may further include one or more retention elements 160, such as one or more straps, buckles, or other fasteners for holding the chest protector 100 on the user.

The chest protector 100 includes a structure 170 configured to reduce the risk of commotio cordis by protecting at least a portion of a user's cardiac silhouette region, which may be defined to include the anterior portion of a user's chest wall that presents a risk of commotio cordis when the chest wall receives an impact. The cardiac silhouette region may include the area of the chest directly anterior to the user's heart, some or all of the user's sternum, and at least a portion of the user's rib cage, for example. The structure 170 is sized, shaped, and positioned to generally coextend with the user's cardiac silhouette region so that it protects the user's heart and reduces the risk of commotio cordis. Accordingly, the structure 170 is generally positioned in the heart zone 180 of a catcher's chest protector 100. The heart zone 180 is understood to be broad enough to include cardiac silhouette regions for users who have most of their heart mass on their left side, and for users who have dextrocardia, in which most heart mass is on the user's right side. Although a representative shape for the structure 170 is illustrated in FIG. 1, any shape suitable for generally coextending with the user's cardiac silhouette region may be implemented in various embodiments.

Figure 2:
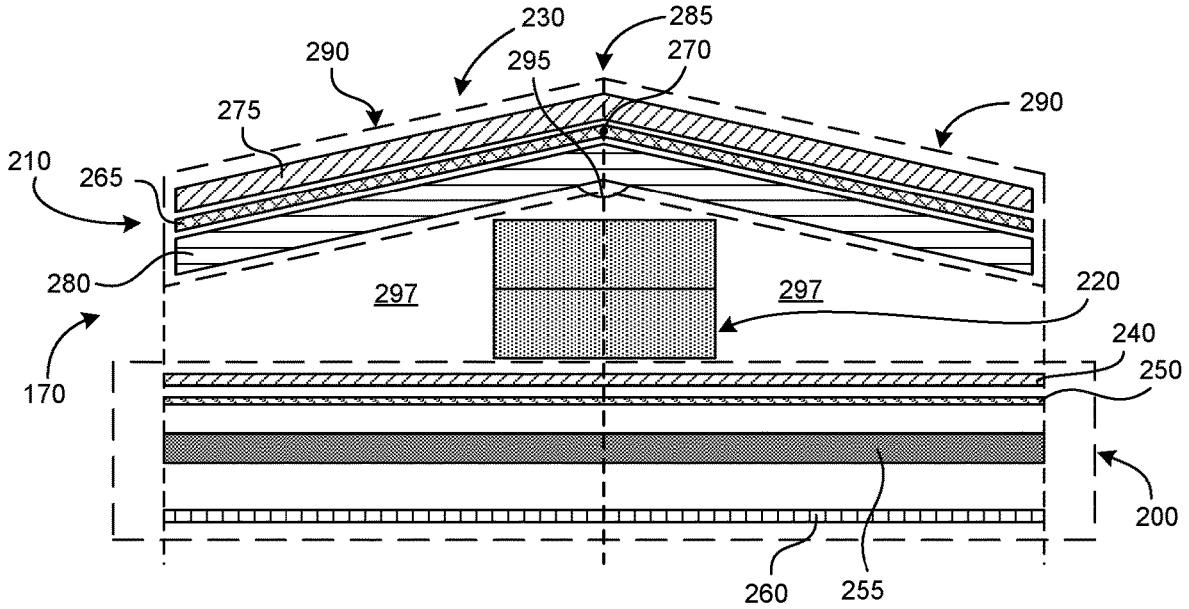

FIG. 2 illustrates a schematic cross-sectional view of the structure 170, taken along line 2-2 in FIG. 1, configured to protect a user's cardiac silhouette region, in accordance with embodiments of the present technology. In some embodiments, the structure 170 includes a base assembly 200, a pivot plate assembly 210, and a fulcrum block 220. In some embodiments, the base assembly 200 is generally flat or generally curved to contour with a user's chest wall, the pivot plate assembly 210 is bent, and the fulcrum block 220 is a rectangular (such as cubic) block. Optionally, any or all of the base assembly 200, the pivot plate assembly 210, and the fulcrum block 220 include material that is resilient and flexible, such as compressible, bendable, or otherwise deformable. In operation, as described in additional detail below, the pivot plate assembly 210 is positioned to pivot on the fulcrum block 220, so that an oncoming ball impacting an anterior side 230 of the pivot plate assembly 210 deflects the ball and components of its momentum and energy in a direction away from the cardiac silhouette and into other parts of the user's body that are less likely to trigger commotio cordis. Optionally, in embodiments where one or more components of the structure 170 are deformable, the structure 170 absorbs energy from the ball in addition to deflecting energy of the ball.

In some embodiments, the base assembly 200 includes one or more layers of foam material. For example, in some embodiments, the base assembly 200 may include one unitary block of foam material or it may include multiple sheets of foam, such as different types of foam. In a particular example, the base assembly 200 may include an anterior base layer 240 formed with viscoelastic foam (such as memory foam) having a thickness between two millimeters and 25 millimeters, such as approximately five millimeters. Beneath the anterior base layer 240 (in a posterior direction, toward the user), the base assembly 200 may include a first interior base layer 250 formed with ethylene-vinyl acetate (EVA) foam having a thickness up to 25 millimeters, such as approximately three millimeters. Beneath the first interior base layer 250 (in a posterior direction, toward the user), the base assembly 200 may further include a second interior base layer 255 formed with vinyl nitrile foam (such as NX160H sold by EvaGlory®) and having a thickness between two and 25 millimeters, such as approximately six millimeters. Beneath the second interior base layer 255 (in a posterior direction, toward the user), the base assembly 200 may further include a posterior base layer 260 formed with waffle foam. In some embodiments, waffle foam may include EVA foam molded with surface contours and perforations, the contours having overall depth between approximately one and five millimeters, or other dimensions. In some embodiments, the posterior base layer 260 may be formed with another foam material suitable for providing structure and cushion. In some embodiments, the first interior base layer 250 may be omitted and the anterior base layer 240 and the second interior base layer 255 may be attached together without a foam or cushion material between them.

The base assembly 200 may coextend with a user's cardiac silhouette region. In some embodiments, the layers 240, 250, 255, and 260 coextend with each other. In other embodiments, one or more of the layers 240, 250, 255, 260 (such as the first interior base layer 250 or another layer) may extend beyond one another or beyond a user's cardiac silhouette region. Together, the layers 240, 250, 255, 260 provide resilient shock absorption for the structure 170 when a ball or other object impacts the pivot plate assembly 210. In embodiments in which the base assembly 200 includes only one layer, the base assembly 200 may still provide resilient shock absorption when the ball or other object impacts the pivot plate assembly 210. In some embodiments, materials other than foam (such as suitable resilient, energy-absorbent materials) may be used to form one or more layers of the base assembly 200.

In some embodiments, the fulcrum block 220 includes one or more layers of foam. For example, the fulcrum block 220 may include one or two layers (or more layers) of vinyl nitrile foam (such as NX160H foam sold by EvaGlory®), or another viscoelastic foam, or another suitable resilient compressible impact-absorbing material (such as EVA foam). In some embodiments, the fulcrum block 220 may include two layers of foam stacked on top of each other and attached together, each layer having a thickness between two and 25 millimeters, such as approximately ten millimeters. In some embodiments, the fulcrum block 220 may have an overall footprint on the base assembly 200 of approximately one inch by one inch. In other embodiments, the fulcrum block 220 may have an overall footprint on the base assembly 200 up to five inches by five inches, or other suitable shapes or dimensions. In some embodiments, the fulcrum block 220 may be formed with any compressible material suitable for facilitating pivoting of the pivot plate assembly 210 in multiple directions relative to the base assembly 200, and for absorbing impact energy. The fulcrum block 220 may be glued, stitched, or otherwise attached to the base assembly 200.

The pivot plate assembly 210 includes a board element 265 configured to provide some rigidity to the pivot plate assembly 210 relative to the foam materials making up other components of the structure 170. In some embodiments, the board element 265 is formed from a polymer material, such as polyethylene or another suitable rigid or semi-rigid material, such as nylon, acrylonitrile butadiene styrene (ABS), acrylic, polypropylene, other plastics, or combinations of suitable materials. The board element 265 may have a thickness between one and ten millimeters, such as approximately three millimeters. The board element 265 may be bent along a vertical axis 270 (generally aligned with a user's longitudinal axis) or otherwise given an angled shape. In FIG. 2, the axis 270 is represented as a dot because the axis 270 extends in and out of FIG. 2, along a direction extending from a superior (upper, closer to the user's head) portion of a chest protector and an inferior (lower, closer to the user's feet) portion of the chest protector. For example, in some embodiments, the board element 265 may be scored along the axis 270, or it may have a channel molded along the axis 270. In some embodiments, the board element 265 may flex about the axis 270. In some embodiments, the board element 265 includes a hinge (such as a living hinge) about the axis 270 to facilitate flexing of the board element 265 about the axis 270 (and generally about the fulcrum block 220), such that the axis 270 is a hinge axis. In some embodiments, the board element 265 may be rigid or semi-rigid. In some embodiments, the board element 265 may have a height (along the axis 270) between 120 millimeters and 300 millimeters, while the board element 265 may also have a width (along a user's transverse axis) between 110 millimeters and 350 millimeters.

In some embodiments, the pivot plate assembly 210 includes one or more layers of foam material. For example, the pivot plate assembly 210 may include a layer of foam material on either side of the board element 265 to sandwich the board element 265 between layers of foam material. As shown in FIG. 2, for example, the pivot plate assembly 210 may include an anterior pivot plate layer 275 positioned toward an anterior direction of the chest protector and a second pivot plate layer 280 positioned opposite the anterior pivot plate layer 275. In some embodiments, the pivot plate layers 275, 280 may be formed from viscoelastic foam, such as memory foam. In some embodiments, the anterior pivot plate layer 275 may have a thickness between two and 25 millimeters, such as approximately five millimeters. In some embodiments, the second pivot plate layer 280 may have a thickness between two and 25 millimeters, such as approximately twelve millimeters. The various layers and components of the pivot plate assembly 210 and the base assembly 200 may be stitched, glued, or otherwise attached together. In some embodiments, some or all layers of foam material in the pivot plate assembly 210 may be omitted and the pivot plate assembly 210 may include only the board element 265.

In some embodiments, a pivot plate assembly 210 may include a hinge 285 about the axis 270. For example, the hinge 285 may include a living hinge or another hinge in the board element 265 (which is described above). The hinge 285 may be a living hinge or merely a bend in the components of the pivot plate assembly 210 sufficient to cause the pivot plate assembly 210 to have a bent shape or a V-shape, as illustrated in FIG. 2. In some embodiments, the pivot plate assembly 210, which is bent or hinged around the axis 270, may include two pivot plate portions 290, which may be oriented at an angle 295 relative to each other. In some embodiments, the angle 295 may be up to 270 degrees. In some embodiments, the pivot plate assembly 210 may be generally flat (no angle), and it may be sufficiently flexible (such as about the axis 270) to be generally flat until it receives an impact. The hinge 285 may be positioned over the fulcrum block 220 so that the pivot plate assembly 210 pivots on the fulcrum block 220 at the hinge 285, and optionally bends around the fulcrum block 220 at the hinge 285 (such that the pivot plate portions 290 articulate relative to each other). In some embodiments, one or more pockets 297 of air may be positioned between the base assembly 200, the pivot plate assembly 210, and the fulcrum block 220.

In some embodiments, when the pivot plate assembly 210 is impacted, it will deform and then return to its original shape as the foam material returns to its original thickness. In some embodiments, the angle 295 may increase during impact as the pivot plate assembly 210 distributes and absorbs impact energy. In some embodiments, the pivot plate assembly 210 is not attached to the base assembly 200 and is instead stacked on the base assembly 200 (and the fulcrum block 220) and restrained in a chest protector (such as under a layer of mesh or other fabric).

Figure 3:
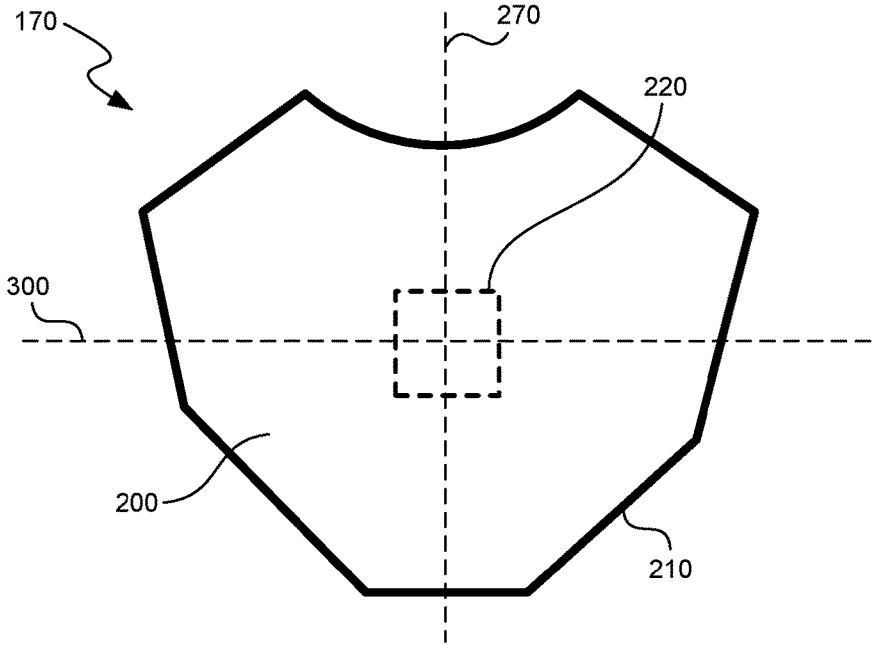
FIG. 3 illustrates a schematic top view of the structure shown in FIGS. 1 and 2.

FIG. 3 illustrates a schematic top view of the structure 170 configured to protect a user's cardiac silhouette region, in accordance with embodiments of the present technology. An impact on the pivot plate assembly 210 may cause the pivot plate assembly 210 to pivot on the fulcrum block 220 about various axes, such as the vertical axis 270 or a horizontal axis 300 (generally aligned with a user's transverse axis), which deflects energy from the impact away from the cardiac silhouette. Although the hinge 285 (see FIG. 2) is illustrated and described as being oriented along the vertical axis 270, in some embodiments, the hinge 285 may be oriented along the horizontal axis 300 or another suitable axis.

Figure 4:
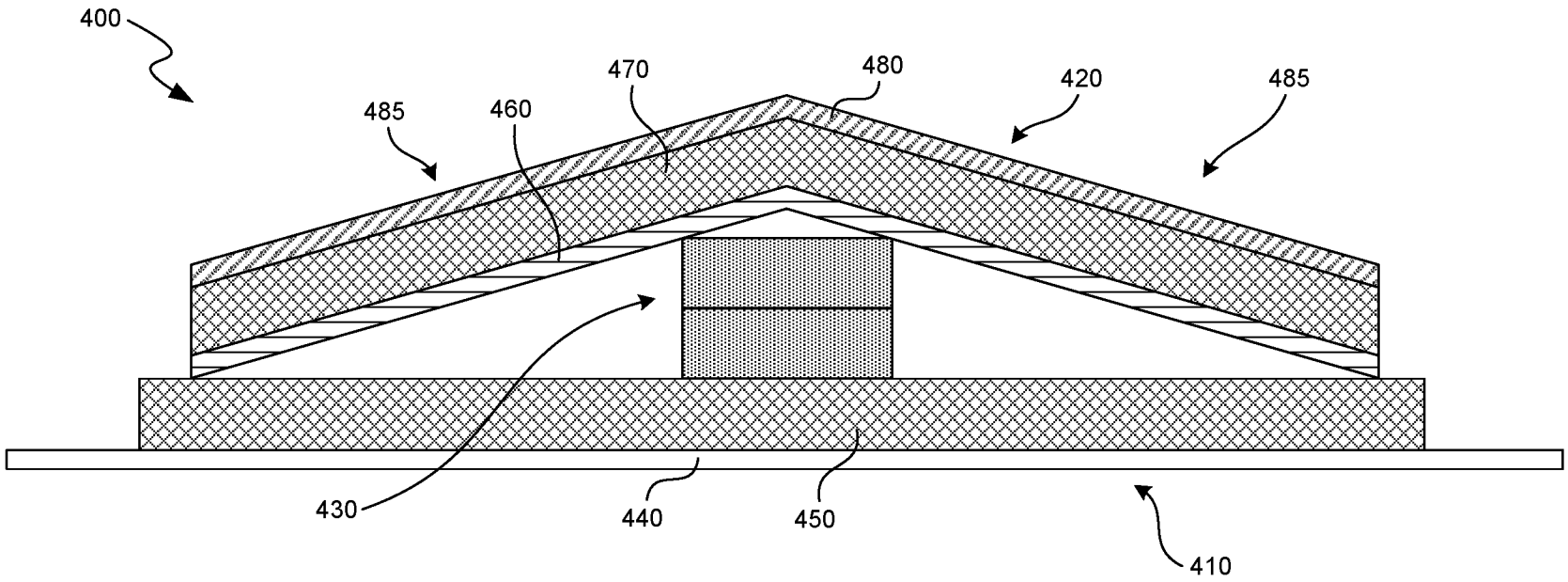
FIG. 4 illustrates a schematic cross-sectional view of another structure configured to reduce the risk of commotio cordis, in accordance with embodiments of the present technology.

FIG. 4 illustrates a schematic cross-sectional view of a structure 400 configured to reduce risk of commotio cordis by protecting a user's cardiac silhouette region, in accordance with other embodiments of the present technology. The structure 400 is generally similar to the structure 170 described above and illustrated in FIGS. 1-3, but it includes another representative arrangement of layers of foam material. For example, the structure 400 includes a base assembly 410, a pivot plate assembly 420, and a fulcrum block 430. In some embodiments, the base assembly 410 includes a posterior base layer 440 formed with a layer of a suitable foam material (such as polyurethane foam, EVA foam, or viscoelastic foam) with a thickness between two and 25 millimeters, such as approximately three millimeters. The posterior base layer 440 may be attached to, or may carry, an anterior base layer 450 formed with memory foam and having a thickness between two and 25 millimeters, such as approximately ten millimeters. In some embodiments, the posterior base layer 440 and the anterior base layer 450 may be formed as a single combined base layer. The fulcrum block 430 may be formed with similar materials to the fulcrum block 220 described above with regard to FIG. 2. The pivot plate assembly 420 may include a board element 460 (which may be similar to the board element 265 described above with regard to FIG. 2). In some embodiments, the board element 460 may not be sandwiched between foam layers, and it may be located in a more posterior position than foam layers in the pivot plate assembly 420. For example, the pivot plate assembly 420 may further include a first pivot plate layer 470, which may include a layer of memory foam having a thickness of approximately ten millimeters, and a second (anterior) pivot plate layer 480, which may include a layer of EVA foam having a thickness between two and 25 millimeters, such as approximately three millimeters. The layers may be glued, stitched, or otherwise suitably attached together, and the structure 400 and its components may be hinged like the structure 170 described above with regard to FIGS. 1-3, such that pivot plate portions 485 articulate relative to each other during impact. In some embodiments, the first pivot plate layer 470 and the second pivot plate layer 480 may be formed as a single combined pivot plate layer.

Although specific types and dimensions of foam are described herein, any suitable type and size or thickness of foam may be implemented in various embodiments of the present technology. In general, the base assemblies (200, 410) and the pivot plate assemblies (210, 420) may be constructed with any number of layers or any types, dimensions, or hardness of foam suitable for providing resilient protection during impact with a ball. The fulcrum blocks (220, 430) may be constructed with any suitable quantity of layers or any types, dimensions, or hardness of foam suitable for providing resilient protection during impact with a ball (via the pivot plate assemblies) and suitable for facilitating pivoting of the pivot plate assemblies. However, viscoelastic foams described herein, such as memory foam or vinyl nitrile foam, will tend to dissipate impact energy more effectively than more elastic materials, such as rubber or ethylene-vinyl acetate (EVA) foam, due to the resistance to shear and strain found in the viscoelastic foams, depending on the specific materials and dimensions of the various implementations.

Advantages of chest protectors in accordance with embodiments of the present technology include reduced risk of commotio cordis for baseball or softball players, such as catchers. The pivoting movement of the pivot plate assemblies (210, 420) dynamically deflects impact energy away from the cardiac silhouette when a ball hits the chest protector, and the deformable or compressible nature of the components of the structures (170, 400) facilitates passive absorption or dissipation of impact energy. The combination of active deflection and passive absorption of impact energy reduces the risk of impacts to the chest wall that could otherwise result in commotio cordis.

Although chest protectors according to embodiments of the present technology may be used in baseball or softball, chest protectors implementing the present technology may be used in any sport or activity that involves risk of impact to the chest wall.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, any suitable number of layers of foam or other resilient materials may be used or omitted while maintaining the active energy deflection characteristics and passive energy absorption characteristics of the structures. Various layers may be combined or omitted such that a chest protector in accordance with some embodiments of the present technology may include a pivot plate assembly (210, 420) formed as a single layer of material, or formed as a single layer of foam material and a board element (265, 460); a fulcrum block (220, 430); and a base assembly (200, 410) formed as a single layer of material (such as foam). Although specific dimensions are provided herein as examples, in various embodiments, other suitable dimensional values may be used. In some particular embodiments, any suitable foam material suitable for receiving an impact may be used if at least one of the layers disclosed herein includes viscoelastic foam.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A chest protector comprising a structure for protecting at least a portion of a cardiac silhouette of a user, the structure comprising:

a base assembly;

a pivot plate assembly; and a fulcrum block positioned between (a) the pivot plate assembly, (b) the base assembly, and (c) an air pocket surrounding the fulcrum block between the pivot plate assembly and the base assembly; wherein the pivot plate assembly is positioned to pivot on the fulcrum block.

2. The chest protector of claim 1 wherein the pivot plate assembly or the fulcrum block includes compressible and resilient material.

3. The chest protector of claim 1 wherein the base assembly is shaped, sized, and positioned to coextend with at least one of a region of the user's sternum or the user's cardiac silhouette.

4. The chest protector of claim 1 wherein the pivot plate assembly comprises two pivot plate portions, the pivot plate portions being oriented at an angle relative to one another.

5. The chest protector of claim 4 wherein the angle is between 120 degrees and 160 degrees.

6. The chest protector of claim 1 wherein the pivot plate assembly comprises a flexible hinge connecting two pivot plate portions, the flexible hinge including a hinge axis aligned along a direction extending between a superior portion of the chest protector and an inferior portion of the chest protector.

7. The chest protector of claim 6 wherein the hinge is positioned over the fulcrum block.

8. The chest protector of claim 1 wherein the fulcrum block comprises foam.

9. The chest protector of claim 1 wherein the pivot plate assembly comprises a polymer board element.

10. A chest protector comprising:

one or more panels configured to generally conform to at least a portion of a user's anterior torso region;

one or more retention elements connected to the one or more panels and positioned to hold the chest protector on the user;

a base assembly positioned to coextend with a region of a user's chest that includes the user's cardiac silhouette;

a pivot plate assembly comprising two pivot plate portions oriented at an angle relative to each other; and a fulcrum block positioned between the pivot plate assembly and the base assembly; wherein the fulcrum block is surrounded by an air pocket located between the pivot plate assembly and the base assembly; and wherein the pivot plate assembly is positioned to pivot on the fulcrum block.

11. The chest protector of claim 10 wherein the pivot plate assembly comprises a living hinge between the two pivot plate portions.

12. The chest protector of claim 10 wherein the pivot plate assembly comprises a polymer board element.

13. The chest protector of claim 12 wherein the pivot plate assembly further comprises viscoelastic foam.

14. The chest protector of claim 10 wherein the fulcrum block comprises foam.

15. The chest protector of claim 10 wherein the angle between the two pivot plate portions is between 120 degrees and 160 degrees.

16. A chest protector comprising:

a base assembly positioned on an anterior surface of the chest protector;

a pivot plate assembly comprising a polymer board element bent around an axis aligned with a user's longitudinal axis when the user is wearing the chest protector, wherein the user's longitudinal axis extends from the user's head to the user's feet, the pivot plate assembly being flexible about the axis; and a fulcrum block positioned between the pivot plate assembly and the base assembly; wherein the pivot plate assembly is positioned to pivot on the fulcrum block.

17. The chest protector of claim 16 wherein the polymer board element comprises polyethylene.

18. The chest protector of claim 16 wherein the fulcrum block comprises foam.

19. The chest protector of claim 16 wherein the base assembly is shaped, sized, and positioned to coextend with a user's cardiac silhouette.

20. The chest protector of claim 16 wherein the pivot plate assembly is not attached to the base assembly, and wherein the pivot plate assembly is restrained to the anterior surface of the chest protector under a layer of fabric.

* * * * *